US007499563B2

(12) United States Patent
Watanabe

(10) Patent No.: US 7,499,563 B2
(45) Date of Patent: Mar. 3, 2009

(54) SPEAKER DEVICE

(75) Inventor: Tomoyuki Watanabe, Yamagata (JP)

(73) Assignees: Pioneer Corporation, Tokyo (JP); Tohoku Pioneer Corporation, Tenso-Shi (JP)

( * ) Notice: Subject to any disclaimer, the term of this patent is extended or adjusted under 35 U.S.C. 154(b) by 788 days.

(21) Appl. No.: 11/083,982

(22) Filed: Mar. 21, 2005

(65) Prior Publication Data

US 2006/0002579 A1 Jan. 5, 2006

(30) Foreign Application Priority Data

Mar. 19, 2004 (JP) ..... 2004-080130

(51) Int. Cl.
*H04R 25/00* (2006.01)

(52) U.S. Cl. ..... 381/412; 381/400; 381/403; 381/407; 381/411; 381/413

(58) Field of Classification Search ..... 381/400, 381/403, 404, 407, 411, 416, 412, 413
See application file for complete search history.

(56) References Cited

U.S. PATENT DOCUMENTS 4,821,331 A * 4/1989 Murayama et al. ..... 381/407
7,386,144 B2 * 6/2008 Vincent et al. ..... 381/412

FOREIGN PATENT DOCUMENTS

JP 2000-278794 10/2000
JP 2003-117486 4/2003

* cited by examiner

*Primary Examiner*—Curtis Kuntz
*Assistant Examiner*—Jasmine Pritchard
(74) *Attorney, Agent, or Firm*—Young & Thompson

(57) ABSTRACT

In a speaker device, when an excessive driving signal larger than a withstand input is inputted to a voice coil, a voice coil bobbin moves with large magnitude. When the voice coil bobbin largely moves on a side opposite to a sound emitting side (downward), each component of the speaker device collides with each other and a large abnormal sound occurs. Therefore, a connecting member and a pot type yoke are designed to collide with each other via a buffer member in an area E1, for example, when the voice coil moves downward with the large magnitude. Namely, the buffer member is attached on a bottom surface of a bent portion of the connecting member, opposite to an upper surface of a cylindrical portion of the pot type yoke, in a circumferential direction.

9 Claims, 8 Drawing Sheets

SPEAKER DEVICE

CROSS-REFERENCE TO RELATED APPLICATIONS

The present application claims priority to and incorporates by reference Japanese Patent Application No. 2004-80130, filed Mar. 19, 2004.

STATEMENT REGARDING FEDERALLY SPONSORED RESEARCH AND DEVELOPMENT

None.

THE NAMES OF PARITIES TO A JOINT RESEARCH PROJECT

None.

INCORPORATION BY REFERENCE OF MATERIAL SUBMITTED ON COMPACT DISC

None.

BACKGROUND OF THE INVENTION

1. Field of the Invention

The present invention relates to a speaker device capable of decreasing occurrence of an abnormal sound due to a collision of components with each other.

2. Description of the Related Art

Conventionally, there is known an internal magnet type speaker device including a magnetic circuit including a plate-shaped magnet, a planar plate and a pot type yoke, and a vibrating system including a damper, a connecting member made of a resin material, a voice coil, a voice coil bobbin and a frame.

In such the speaker device, the connecting member in a substantially cylindrical shape is mounted to the voice coil bobbin in order to cover an outer peripheral wall of the voice coil bobbin. An inner peripheral edge portion of the damper is attached to an outer peripheral wall of the connecting member. Thus, when the speaker device is driven, the connecting member, which is supported by the damper, is vibrated in an axial direction of the speaker device together with the voice coil bobbin.

In such the speaker device, when an excessive driving signal larger than a withstand input is inputted to the voice coil, the voice coil bobbin largely moves in the axial direction of the speaker device. When the voice coil bobbin largely moves on a side of the pot type yoke, i.e., on a side opposite to a sound emitting side (downward), the connecting member made of the resin material collides with the frame and pot type yoke made of a metal material, and a large abnormal sound problematically occurs.

There are also known a multi-functional vibrating actuator (see Japanese Patent Application Laid-Open No. 2003-117486) which prevents direct collision of the yoke and a cover and prevents a abnormal sound by collision from occurring when the magnetic circuit causes an abnormal vibration, and a multi-functional sound production model (see Japanese Patent Application Laid-Open No. 2000-278794) which prevents a deformation of a diaphragm and a damage due to the collision of the components with each other when an impact power is received.

BRIEF SUMMARY OF THE INVENTION

As an object to be achieved by the present invention, the above described object is cited as an example. The present invention has its object to provide a speaker device capable of preventing a connecting member from directly colliding with a frame and a pot type yoke to decrease occurrence of a large abnormal sound when a voice coil bobbin largely moves downward.

According to one aspect of the present invention, there is provided a speaker device including: a voice coil bobbin; a connecting member which is mounted to the voice coil bobbin; and a pot type yoke, wherein a buffer member is placed on a position at which the connecting member and the pot type yoke collide with each other, when the voice coil bobbin moves on a side of the pot type yoke at a time of driving.

In the above-mentioned speaker device, when an excessive driving signal larger than a withstand input is inputted to the voice coil, a vibrating system such as the voice coil bobbin moves with the large magnitude in an axial direction of the speaker device. Particularly, when the voice coil bobbin and the like largely move on the side of the pot type yoke, i.e., on the side opposite to the sound emitting side (downward), the connecting member and the pot type yoke usually collide with each other, and the large abnormal sound occurs. However, in the above speaker device, the buffer member is attached to the position at which the connecting member made of the resin material and the pot type yoke made of the metal material, for example, collide with each other when the voice coil bobbin largely move on the side of the pot type yoke. Therefore, when the voice coil bobbin largely moves downward, since the connecting member elastically collides with the pot type yoke via the buffer member, the occurrence of the large abnormal sound can be effectively prevented. At the same time, damage of the connecting member can be prevented. In a preferred example, the buffer member may be a member having elasticity such as a cushion material and a sponge, for example.

In a form of the above speaker device, the pot type yoke may have a cylindrical portion opposite to an outer peripheral wall of the voice coil bobbin, and the buffer member may be placed on a surface, opposite to an upper surface of the cylindrical portion, of the connecting member.

In accordance with the form, the connecting member and the upper surface of the cylindrical portion of the pot type yoke are designed to collide with each other when the voice coil bobbin and the like largely move downward. Thereby, structurally, the collision of other components of the speaker device and the pot type yoke can be avoided. In the form, the buffer member is attached on the surface of the connecting member, which is opposite to the upper surface of the cylindrical portion. Thus, when the voice coil bobbin and the like largely move downward, the bottom surface of the connecting member and the upper surface of the cylindrical portion opposite to it elastically collide with each other via the buffer member. Therefore, the occurrence of the large abnormal sound can be decreased, and the damage of the connecting member can be prevented.

In a preferred example, the buffer member may be placed on the connecting member in its entire circumference, or may be discontinuously placed on the connecting member in its circumferential direction.

According to another aspect of the present invention, there is provided a speaker device including: a voice coil bobbin; a connecting member which is mounted to the voice coil bobbin; a pot type yoke; and a frame, wherein the connecting member has a cylindrical portion opposite to an outer peripheral wall of the pot type yoke; wherein the pot type yoke has a flange part opposite to a bottom surface of the cylindrical portion; wherein the frame is mounted on an upper surface of the flange part; and wherein a buffer member is attached to a position at which the connecting member collides with the frame or the pot type yoke, when the voice coil bobbin moves on a side of the pot type yoke at a time of driving.

In the above-mentioned speaker device, when the excessive driving signal larger than the withstand input is inputted to the voice coil, the vibrating system such as the voice coil bobbin moves in the axial direction of the speaker device with the large magnitude. In the speaker device, the frame or the pot type yoke and the connecting member are designed to elastically collide with each other via the buffer member when the voice coil bobbin moves downward with the large magnitude. Thereby, structurally, the collision of the other components of the speaker device and the pot type yoke can be avoided. In addition, the occurrence of the large abnormal sound can be effectively decreased, and the damage of the connecting member can be prevented.

In a form of the above speaker device, the buffer member may be attached on the bottom surface of the cylindrical portion. In another form of the above speaker device, the buffer member may be attached to the frame or the pot type yoke. Therefore, when the voice coil bobbin moves downward with the large magnitude, the bottom surface of the cylindrical portion of the connecting member elastically collides with the frame or pot type yoke opposite to it via the buffer member. Thus, the occurrence of the large abnormal sound can be decreased, and the damage of the connecting member can be prevented.

In a preferred example, the buffer member may be placed on the connecting member in its entire circumference, or may be discontinuously placed on the connecting member in its circumferential direction.

DETAILED DESCRIPTION OF THE INVENTION

A preferred embodiment of the present invention will be explained hereinafter with reference to the drawings. In this embodiment, when the voice coil bobbin moves with the large magnitude, the direct collision of the connecting member with the frame and the pot type yoke is avoided, and the occurrence of the abnormal sound is suppressed.

Figure 1:
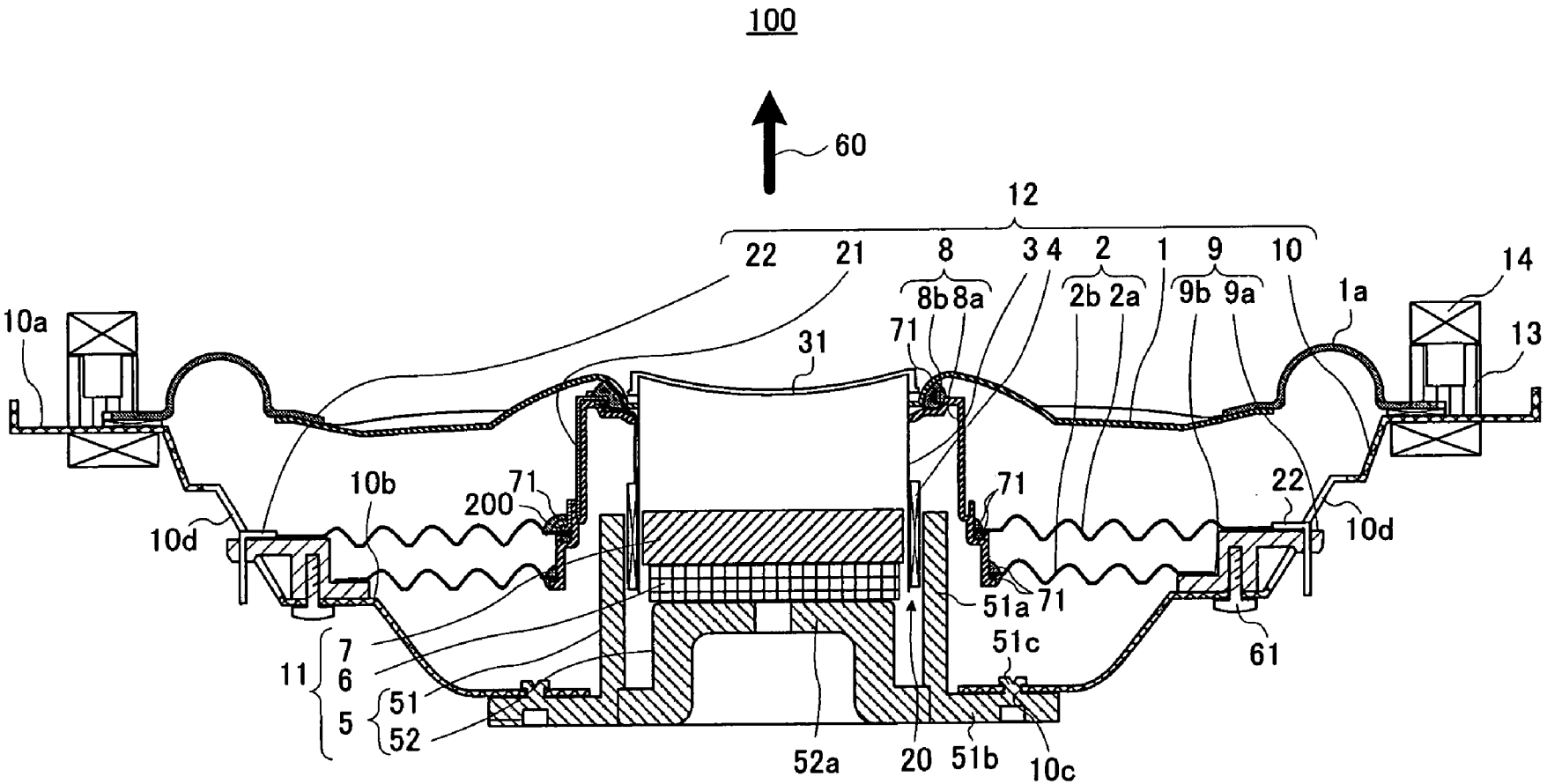
FIG. 1 is a sectional view of a speaker device according to an embodiment of the present invention.

A general construction of a speaker device 100 according to the embodiment of the present invention will be schematically shown in FIG. 1. The speaker device 100 of this embodiment can be preferably used as an on-vehicle speaker. FIG. 1 shows a sectional view when cutting the speaker device 100 by a plane including a central axis thereof. A construction and the like of the speaker device 100 of this embodiment will be explained hereinafter with reference to FIG. 1.

As shown in FIG. 1, the speaker device 100 mainly includes a vibrating system 12 having a frame 10, a support member 9, a voice coil bobbin 3, a connecting member 8, a damper 2, terminal members 21, second type terminal members 22, a voice coil 4 and a diaphragm 1, a magnetic circuit system 11 having a pot type yoke 5, a magnet 6 and a plate 7, an anti-dust cap 31, and other various kinds of members.

First, each component of the vibrating system 12 will be explained.

Various components of the speaker device 100 are fixed to the frame 10, and the frame 10 has the function of supporting these components. The frame 10 is made of a metal material of good thermal conductivity. Therefore, the frame 10 has the function as a medium for giving and receiving heat to and from an external space of the speaker device 100 and its internal space. The frame 10 is formed into a pan-shape or pot-shape which is opened upward, and has a first flange part 10*a* formed at the top part for supporting an outer peripheral edge portion and the like of the diaphragm 1, a second flange part 10*b* formed at an intermediate part for supporting the support member 9, openings 10*c* formed in an inner peripheral edge portion, and a plurality of openings 10*d* formed at a side wall between the first flange part 10*a* and the second flange part 10*b*. A plurality of openings 10*c* are formed with fixed spaces therebetween in a circumferential direction of the inner peripheral edge portion. Each of the projecting portions 51*c* of the pot type yoke 5 before deformation, which will be described later, is inserted into each of the openings 10*c*.

The support member 9 is formed of, for example, a resin material, and is formed into a substantially annular shape in the plane view. The support member 9 is formed into a step shape in the sectional view, and has a top surface 9*a* and a top surface 9*b*. The support member 9 is mounted to the second flange part 10*b* by a fixing member 61 such as a male screw and a bolt.

The voice coil bobbin 3 is formed into a substantially cylindrical shape. The voice coil 4 is wound around an outer peripheral wall of a lower end portion of the voice coil bobbin 3. The inner peripheral wall of the lower end portion of the voice coil bobbin 3 is opposed to outer peripheral walls of the planar magnet 6 and plate 7 with a fixed space from them. The outer peripheral wall of the lower end portion of the voice coil bobbin 3 is opposed to an outer peripheral wall of an upper end portion of a pole piece 5 at a fixed space from it. A clearance (magnetic gap 20) is formed between an inner peripheral wall of the upper end portion of the pole piece 5 and an outer peripheral wall of the plate 7.

The connecting member 8 is formed of, for example, a resin material, has a cylindrical portion 8*a* formed into a substantially cylindrical shape and a bent portion 8*b* formed in a fashion being bent inwardly from an upper end of the cylindrical portion 8*a*, and is made by integrally forming them. An inner peripheral edge portion of the connecting member 8, namely, an inner peripheral edge portion of the bent portion 8*b* is fixed to an area in the vicinity of the upper end of the outer peripheral wall of the voice coil bobbin 3.

The damper 2 has a conductive damper 2*a* and an ordinary damper 2*b*. The conductive damper 2*a* is disposed above the damper 2*b*. The conductive damper 2*a* has a plurality of conductive members not shown. Each of the conductive members is sewn onto a top surface of the conductive damper 2*a* from the inner peripheral edge portion of the conductive damper 2*a* to its outer peripheral edge portion. The outer peripheral edge portion of the damper 2*b* is fixed to the top surface 9*b* of the support member 9 and the inner peripheral edge portion of the damper 2*b* is fixed to a lower end portion of the connecting member 8. Meanwhile, the outer peripheral edge portion of the conductive damper 2*a* is fixed to the top surface 9*a* of the support member 9 and the inner peripheral edge portion of the conductive damper 2*a* is fixed to an area in the vicinity of the lower end of the connecting member 8.

The terminal member 21 is a member such as metal having conductivity, and a plurality of terminal members 21 are provided. Each terminal member 21 is mounted to the connecting member 8. The upper end of each of the terminal members 21 is electrically connected to each lead wire of the voice coil 4, and a lower end of each of the terminal members 21 is electrically connected to each of the conductive members of the conductive damper 2*a*.

The second type terminal member 22 is a member having conductivity, and a plurality of second type terminal members 22 are provided. Each of the second type terminal members 22 is fixed to the top surface 9*a* of the support member 9. One end of each of the second type terminal members 22 is electrically connected to each of the conductive members of the conductive damper 2*a*, and the other end of each of the second type terminal members 22 is electrically connected to a relay wiring at an amplifier side not shown.

The voice coil 4 has a pair of positive/negative lead wires (not shown). A lead wire at the positive side is an input wiring for an L (or R) channel signal, and a lead wire at the negative side is an input wiring for a ground (GND: ground) signal. Each lead wire is electrically connected to the upper end of each of the terminal members 21 as described above. Therefore, an electric signal of one channel is inputted from the amplifier side into the voice coil 4 via each of the second type terminal members 22, each of the conductive members of the conductive damper 2*a*, each of the terminal members 21 and each of the lead wires.

The diaphragm 1 is formed into a substantially planer shape to be made thin. Various kinds of materials such as paper, polymer, and metal can be applied to the diaphragm 1 in accordance of the various kinds of use purposes. The edge portion 1*a* which is a separate piece from the diaphragm 1 is mounted to an outer peripheral edge portion of the diaphragm 1*a*. The outer peripheral edge portion of the diaphragm 1 is fixed to the first flange part 10*a*. Meanwhile, an inner peripheral edge portion of the diaphragm 1 is fixed to the area in the vicinity of the upper end of the outer peripheral wall of the voice coil bobbin 3.

Next, each component of the magnetic circuit 11 will be explained.

The magnetic circuit system 11 is constructed as the internal magnet type magnetic circuit. This magnetic circuit has the pot type yoke 5, the planar magnet 6 and the planar plate 7. The pot type yoke 5 has a body part 51 and a bottom part 52, and they are bonded together. The pot type yoke 5 is mounted on frame 10.

The body part 51 has a cylindrical portion 51*a*, a flange part 51*b*, and projecting portions 51*c* projecting upward from the top surface of the flange part 51*b*, and is formed by integrating them. The cylindrical portion 51*a* is formed into a substantially cylindrical shape. The cylindrical portion 51*a* extends upward from the area in the vicinity of the inner circumference of the flange part 51*b* to the position in the vicinity of the plate 7. The flange part 51*b* extends in the outward direction substantially perpendicularly from the position in the vicinity of the lower end of the outer peripheral wall of the cylindrical portion 51*a*. The inner peripheral edge portion of the frame 10 is mounted to the top surface of the flange part 51*b*. The projecting portion 51*c* is formed into the columnar shape and a plurality of projecting portions 51*c* are formed on the top surface of the flange part 51*b* with fixed spaces from each other. Each of the projecting portions 51*c* has the function of fixing the inner peripheral edge portion of the frame 10 by being caulked.

The bottom part 52 has the sectional shape of substantially inversed recessed shape. The bottom part 52 has a mounting portion 52*a* which has substantially the same size as the diameters of the planer magnet 6 and the planar plate 7. The outer peripheral edge portion of the bottom part 52 is connected to the body part 51.

The planar magnet 6 is fixed onto the mounting portion 52*a* of the bottom part 52 of the pot type yoke 5. The planar plate 7 is fixed onto the magnet 6. In the magnetic circuit system 11, the magnetic circuit is constructed by the magnet 6 and the plate 7, and magnetic flux of the magnet 6 is concentrated at the magnetic gap 20 formed between the outer peripheral wall of the plate 7 and the inner peripheral wall of the pot type yoke 5.

The anti-dust cap 31 is mounted to the upper end portion of the voice coil bobbin 3 via the adhesive so as to close the top surface of the voice coil bobbin 3. Thereby, the anti-dust cap 31 has the function of preventing a foreign matter or the like from entering the inside of the speaker device 100.

Next, various kinds of component members will be explained.

Various kinds of component members include a packing 13, a buffer member 14 and the like.

The packing 13 is formed into an annular shape and is the member having insulating property. As the material for the packing 13, for example, a resin material is preferable. The bottom surface of the packing 13 is fixed to the first flange part 10*a* and the outer peripheral edge part of the edge portion 1*a*. Thereby, the outer peripheral edge part of the diaphragm 1 and the edge portion 1*a* is sandwiched by the packing 13 and the first flange part 10*a*.

The buffer member 14 has the function as the buffer material when the speaker device 100 is mounted to a predetermined position of the vehicle, for example, and has the function and the like of preventing the vibration from the outside from being transmitted to the body of the speaker device 100. Therefore, as the material of the buffer member 14, for example, a member having cushioning property such as sponge is preferable. The buffer member 14 has a rod shape before being mounted, and an adhesive is applied to one side surface, or a double-side adhesive tape is attached to one side surface. The buffer member 14 is attached on the upper surface of the packing 13 via the adhesive or the double-side adhesive tape in the state in which it is deformed in an annular shape.

In the speaker device 100 which is described above, an electric signal outputted from the amplifier is supplied to the voice coil 4 via each of the second type terminal members 22, each of the conductive members of the conductive damper 2*a*, each of the terminal members 21 and each lead wire of the voice coil 4. Thereby, driving force occurs to the voice coil 4 in the magnetic gap 20, and vibrates the diaphragm 1 in the axial direction of the speaker device 100. Thus, the speaker device 100 emits acoustic waves in the direction of the arrow 60.

[Structure of Decreasing Abnormal Sound of Speaker Device]

Figure 2:
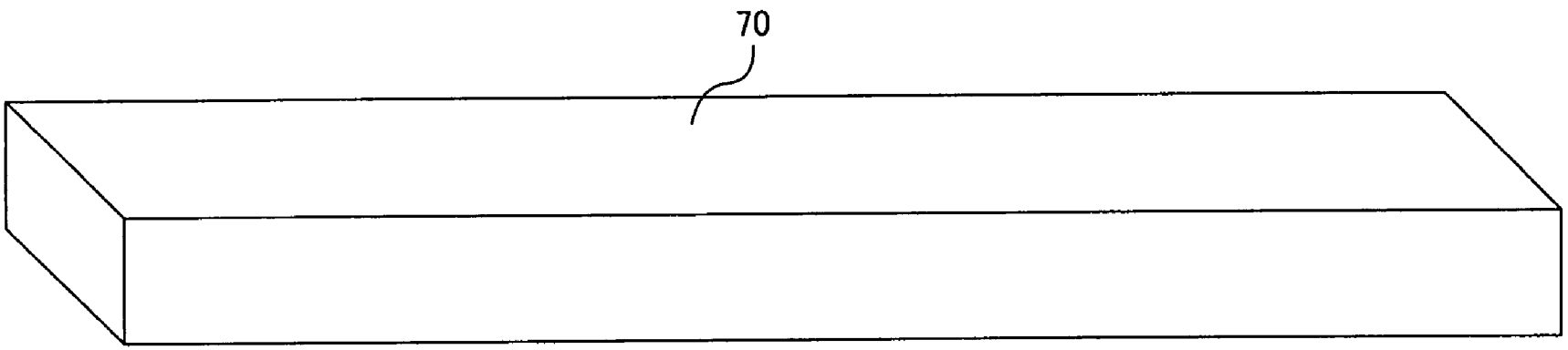
FIG. 2 is a perspective view schematically showing an embodiment of a buffer member.
Figure 6:
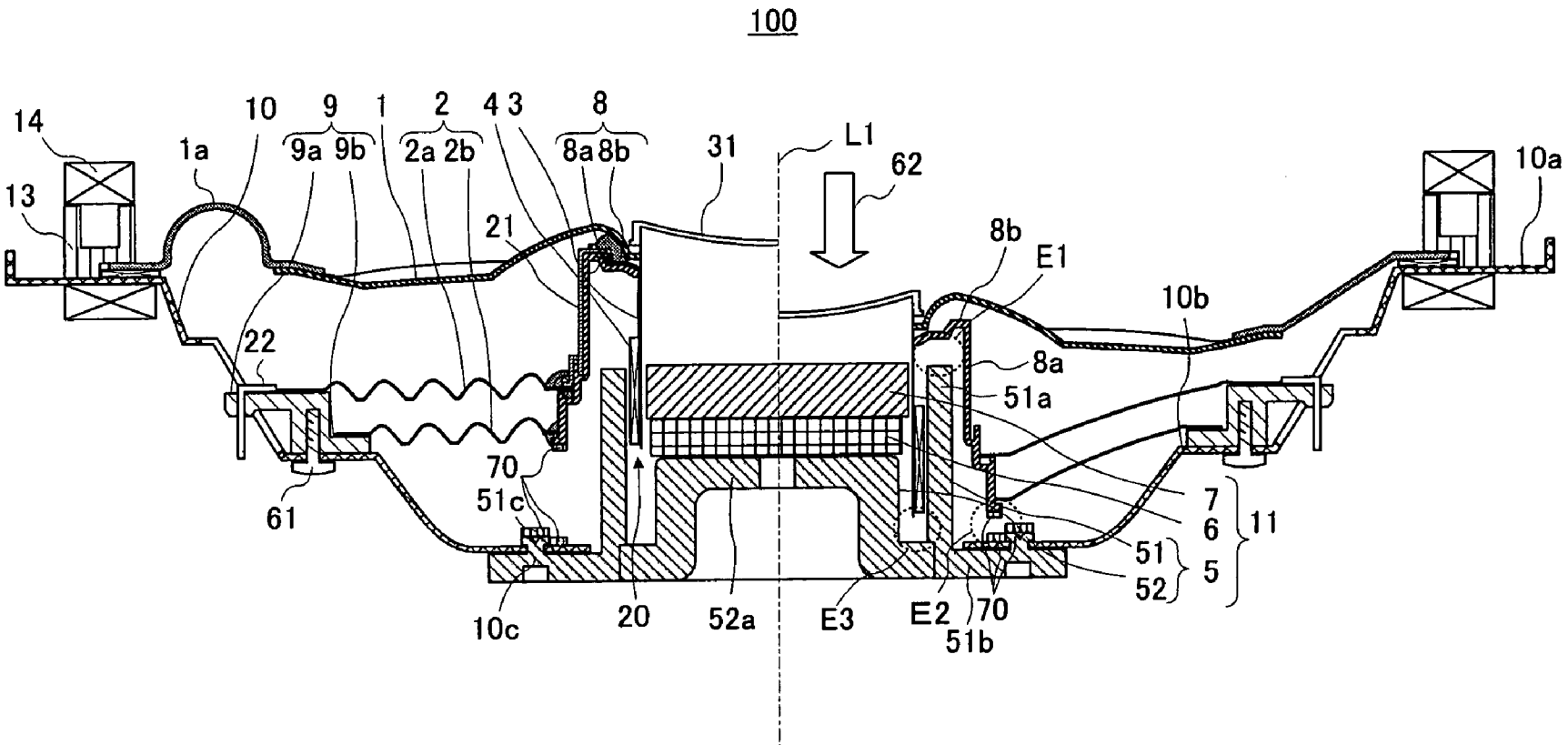
FIG. 6 shows a sectional view of the speaker device having the abnormal sound decreasing structure according to a fourth embodiment.
Figure 7B:
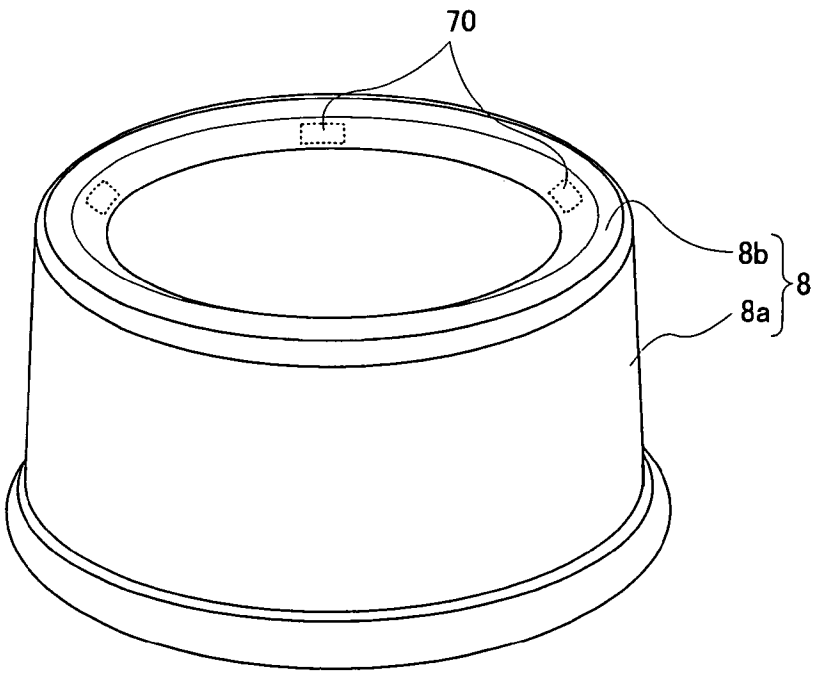
FIGS. 7A and 7B show perspective views of connecting members in a condition that the buffer member is attached to a bottom surface of a bent portion.
Figure 7A:
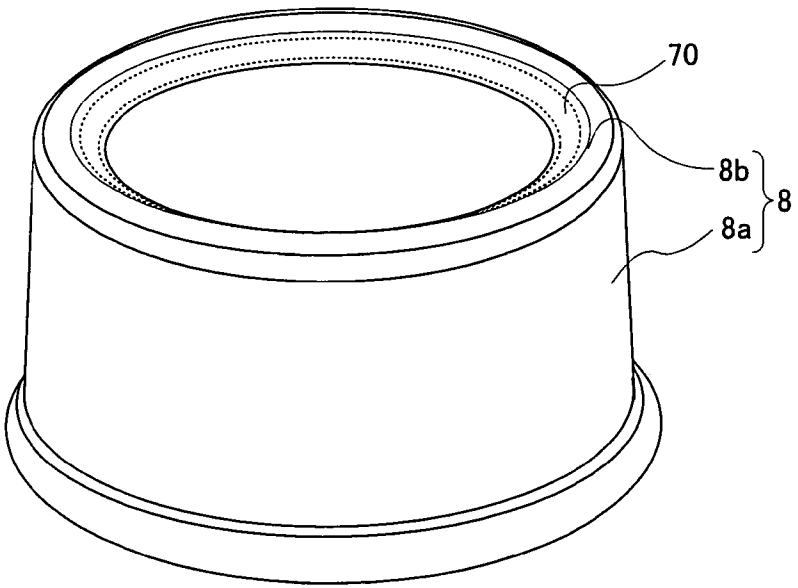
Figure 8B:
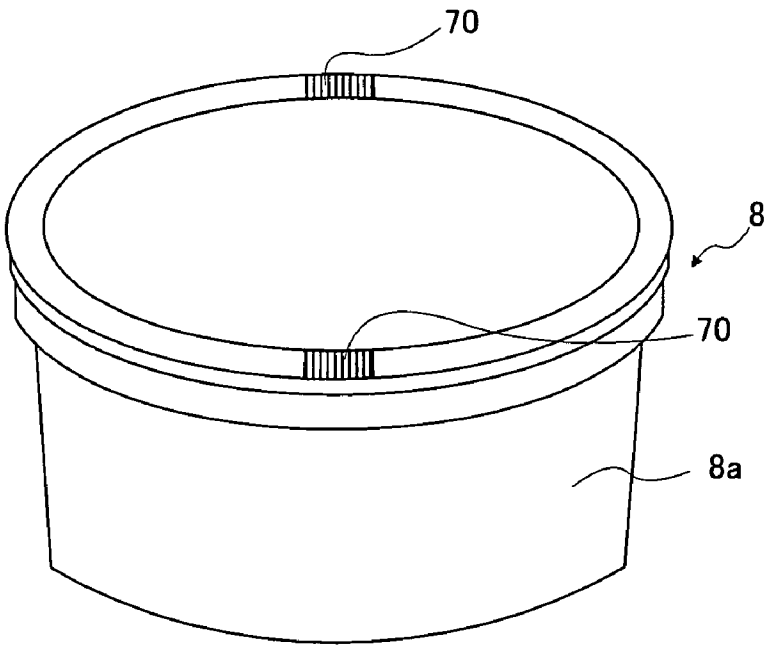
FIGS. 8A and 8B show perspective views of connecting members in a condition that the buffer member is attached to a bottom surface of a cylindrical portion.
Figure 8A:
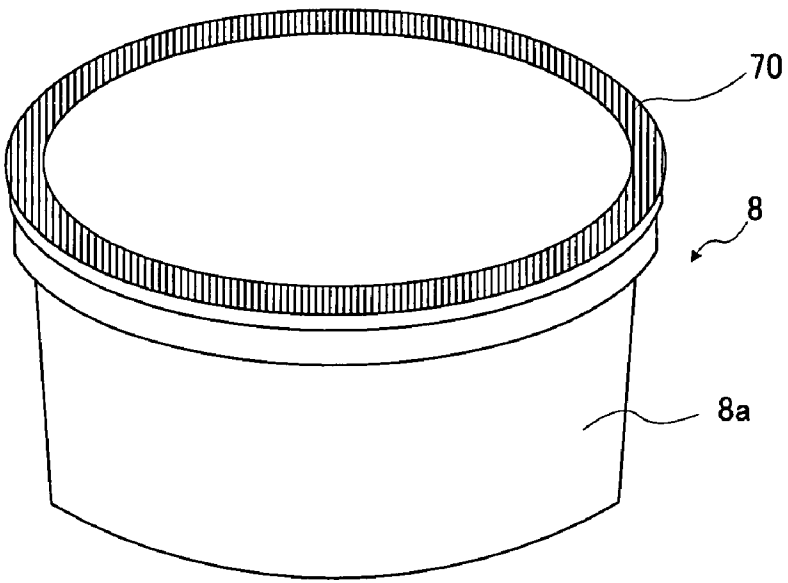

Next, the description will be given of a structure capable of effectively decreasing an abnormal sound caused due to collision of each component of the speaker device 100, when the voice coil bobbin 3 and the like vibrate downward with the large magnitude, with reference to FIG. 2 to FIG. 8. FIG. 2 is a perspective view schematically showing a structure of a second type buffer member 70. FIG. 3 to FIG. 6 show sectional views of the speaker device 100 according to each embodiment. In addition, FIG. 3 to FIG. 6 show structures capable of decreasing the occurrence of the abnormal sound, which are correspondent to each embodiment. For convenience of the explanation, in FIG. 3 to FIG. 6, the position of the speaker device 100 in a stationary state is shown on the left side with respect to the central axis L1 of the speaker device 100, and the position of the speaker device 100 in a case of vibrating with the large magnitude in the direction of an arrow 62 is shown on the right side. FIGS. 7A and 7B show perspective views of the connecting member 8 observed from a front side. FIGS. 7A and 7B show such a state that the second type buffer member 70 (see the inside of an area shown by the broken lines) in various forms is attached to the bottom surface of the bent portion 8*b* of the connecting member 8. FIGS. 8A and 8B schematically show perspective views of the connecting member 8 observed from the back side. In addition, FIGS. 8A and 8B show such states that the second type buffer member 70 (see the inside of a hatching area) in various forms is attached to the bottom surface of the cylindrical portion 8*a* of the connecting member 8.

In the speaker device 100, when the excessive driving signal larger than the withstand input is inputted to the voice coil 4, the voice coil bobbin 3 and the like are vibrated with the large magnitude in the direction of the central axis L1 of the speaker device 100. At this time, as shown on the right side of FIG. 3, if the voice coil bobbin 3 and the like largely moves downward (in the direction of the arrow 62), each component of the speaker device 100 may collide with each other in the areas E1 to E3.

If the speaker device 100 is designed to make each component collide with each other in the area E3, at the time of the downward movement of the voice coil bobbin 3 and the like with the large magnitude, the lower end portion of the voice coil 4 collides with the outer peripheral edge portion of the bottom part 52 of the pot type yoke 5. As a result, the voice coil 4 may be damaged. Therefore, when the speaker device 100 is designed, the connecting member 8 is designed to collide with the frame 10 and the pot type yoke 5 in the area E1 or E2 at the time of the downward movement of the voice coil bobbin 3 and the like with the large magnitude. However, due to such the collision, the connecting member 8 made of the resin material collides with the frame 10 and pot type yoke 5 made of the metal material, which causes the large abnormal sound.

In each embodiment below, in order to decrease the occurrence of such the large abnormal sound, the second type buffer member 70 is attached to the position at which the connecting member 8 collides with the frame 10 and the pot type yoke 5. The second type buffer member 70 has the function as the cushioning material. As the material of the second type buffer member 70, for example, a member having cushioning property such as sponge is preferable. The second type buffer member 70 has a rod shape before being mounted, and an adhesive is applied to one side surface. The second type buffer member 70 is attached on a predetermined portion via the adhesive in the state in which it is deformed in an annular shape or in the state in which it is cut into an appropriate size.

FIRST EMBODIMENT

The description will be given of a structure of a first embodiment with reference to FIG. 3 and FIGS. 7A and 7B. In the first embodiment, the buffer member 8 is designed to collide with the pot type yoke 5 via the second type buffer member 70 in the area E1. Thereby, in the areas E2 and E3, structurally, the collision of each component of the speaker device 100 can be avoided, and the occurrence of the large abnormal sound in the area E1 can be suppressed.

Figure 3:
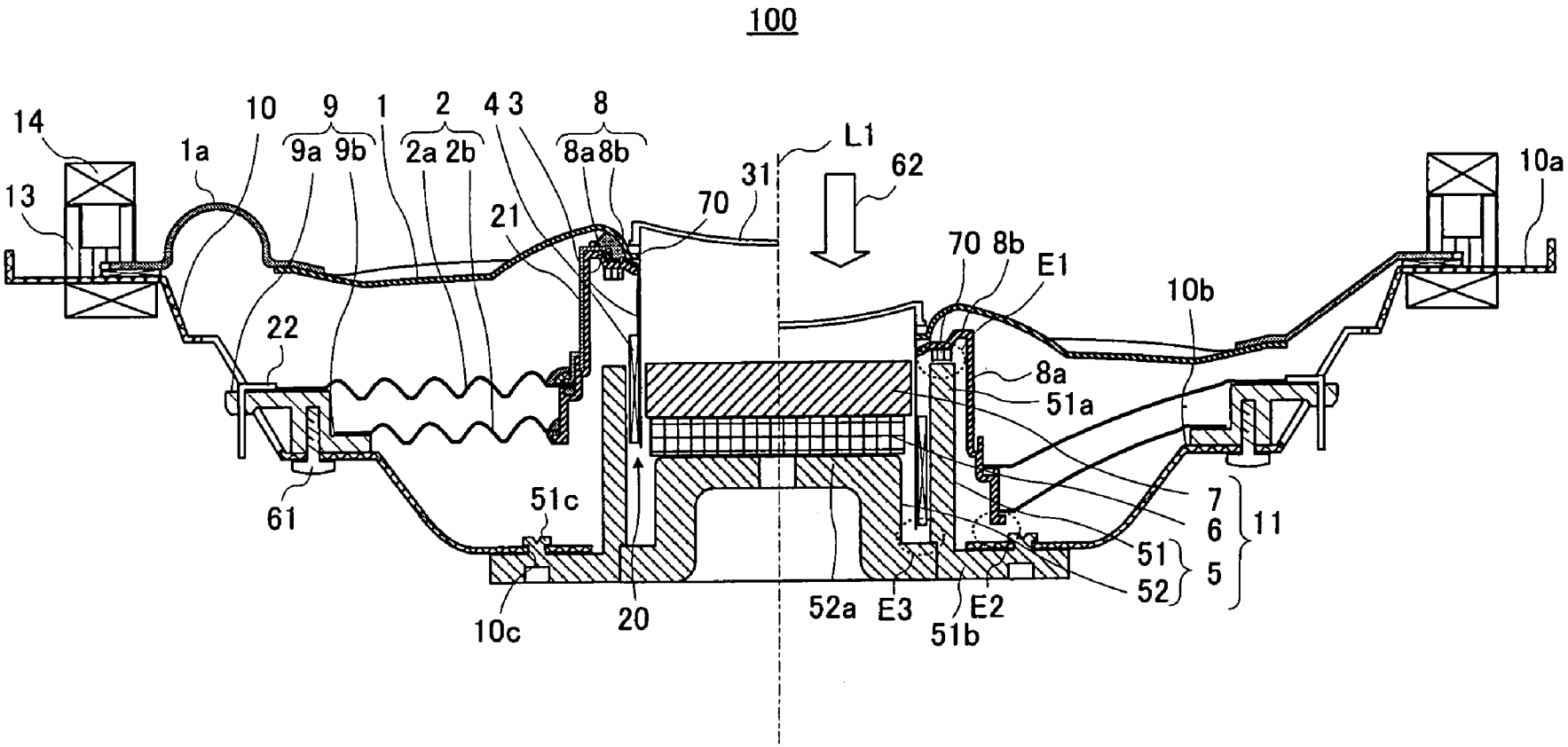
FIG. 3 shows a sectional view of a speaker device having an abnormal sound decreasing structure according to a first embodiment.

Concretely, in the first embodiment, the second type buffer member 70 is attached on the surface opposite to the upper surface of the cylindrical portion 51*a*, i.e., the bottom surface of the bent portion 8*b*, in its circumferential direction, as shown in FIG. 3 and FIG. 7A. Instead, as shown in FIG. 7B, the plural small-shape second type buffer members 70 may be discontinuously or intermittently attached on the bottom surface of the bent portion 8*b* in its circumferential direction respectively. When the excessive driving signal larger than the withstand input is inputted to the voice coil 4 and the voice coil bobbin 3 and the like largely move in the direction of the arrow 62, the bottom surface of the bent portion 8*b* and the upper surface of the cylindrical portion 51*a* elastically collide with each other via the second type buffer member 70 in the area E1. Thereby, the occurrence of the large abnormal sound can be effectively suppressed, and the damage of the connecting member 8 can be prevented.

SECOND EMBODIMENT

Next, the description will be given of a structure according to a second embodiment with reference to FIG. 4 and FIGS. 8A and 8B. In the second embodiment, the connecting member 8 is designed to collide with the frame 10 via the second type buffer member 70 in the area E2. Thereby, in the areas E1 and E3, structurally, the collision of each component of the speaker device 100 can be avoided, and the occurrence of the abnormal sound in the area E2 can be suppressed.

Figure 4:
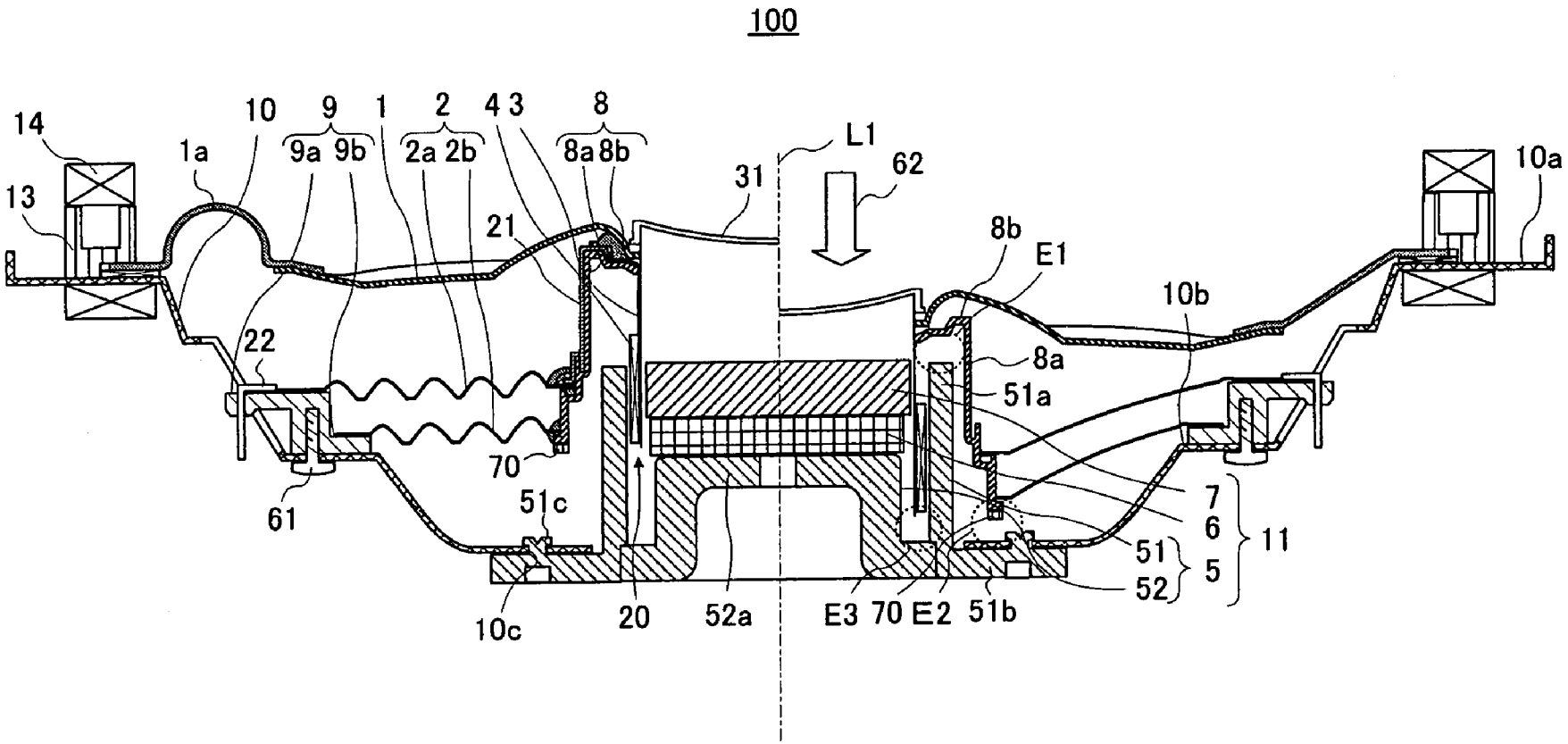
FIG. 4 shows a sectional view of the speaker device having the abnormal sound decreasing structure according to a second embodiment.

Concretely, in the second embodiment, as shown in FIG. 4 and FIG. 8A, the second type buffer member 70 is attached on the bottom surface of the cylindrical portion 8*a*, opposite to the upper surface of the inner peripheral edge portion of the frame 10, in its circumferential direction. Instead, as shown in FIG. 8B, the plural small-shape second type buffer members 70 may be discontinuously attached on the bottom surface of the cylindrical portion 8*a* in its circumferential direction respectively. When the excessive driving signal larger than the withstand input is inputted to the voice coil 4 and the voice coil bobbin 3 and the like largely move in the direction of the arrow 62, in the area E2, the bottom surface of the cylindrical portion 8*a* and the upper surface of the inner peripheral edge portion of the frame 10 elastically collide with each other via the second type buffer member 70. Thereby, the occurrence of the large abnormal sound can be effectively decreased, and the damage of the connecting member 8 can be prevented.

THIRD EMBODIMENT

Next, the description will be given of a structure according to a third embodiment with reference to FIG. 5. In the third embodiment, similarly to the second embodiment, the connecting member 8 is designed to collide with the frame 10 via the second type buffer member 70 in the area E2. Thereby, structurally, in the areas E1 and E3, the collision of each component of the speaker device 100 can be avoided, and the occurrence of the large abnormal sound in the area E2 can be decreased.

Figure 5:
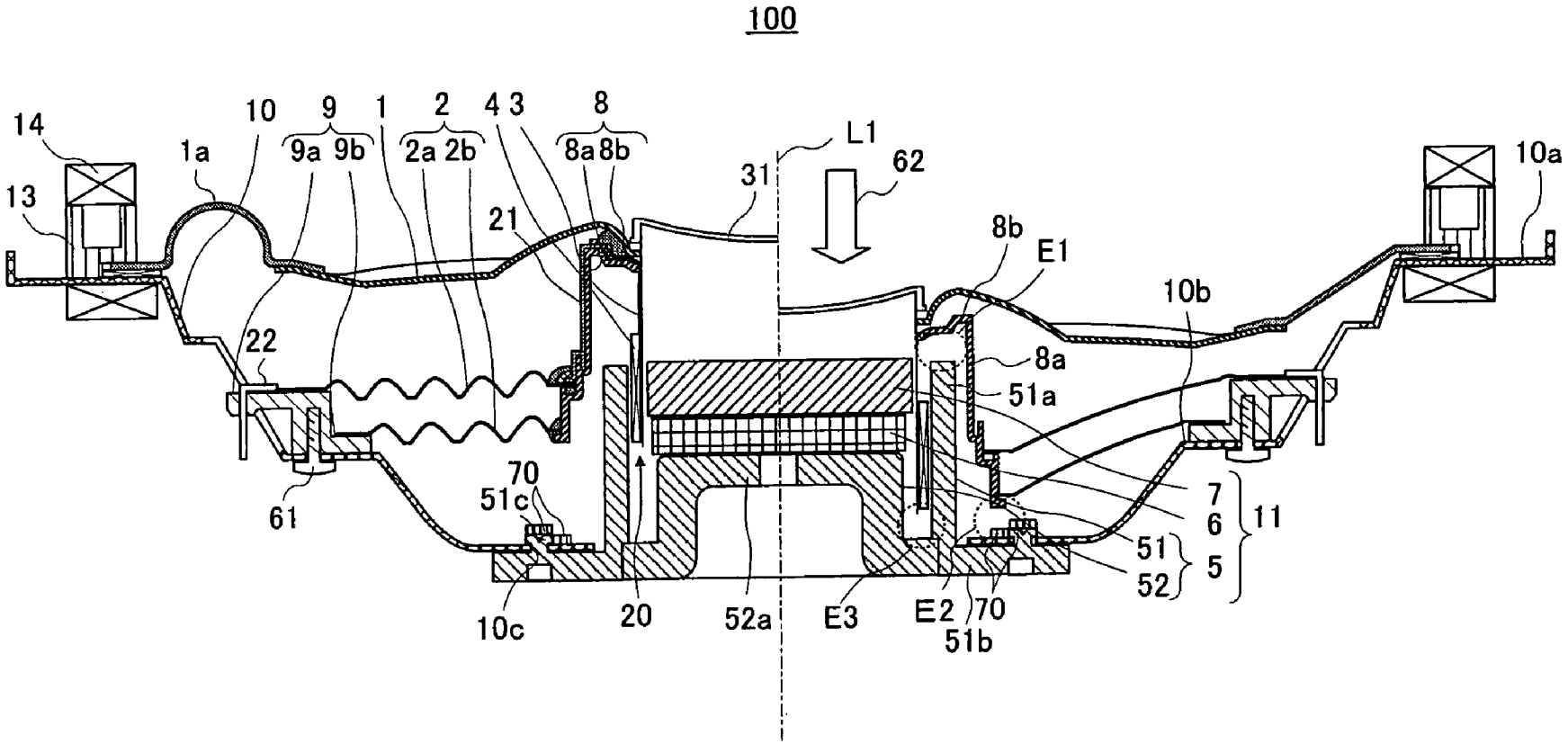
FIG. 5 shows a sectional view of the speaker device having the abnormal sound decreasing structure according to a third embodiment.

Concretely, in the third embodiment, as shown in FIG. 5, the second type buffer member 70 is attached on the upper surface of the inner peripheral edge portion of the frame 10, opposite to the bottom surface of the cylindrical portion 8*a* of the connecting member 8, in its circumferential direction. Instead, the plural small second type buffer members 70 may be discontinuously attached on the upper surface of the inner peripheral edge portion of the frame 10 in its circumferential direction respectively. As the need arises, as shown in FIG. 5, the second type buffer member 70 may be attached on the upper surface of the projecting portion 51*c* of the pot type yoke 5, too. When the excessive driving signal larger than the withstand input is inputted to the voice coil 4 and the voice coil bobbin 3 and the like largely move in the direction of the arrow 62, in the area E2, the cylindrical portion 8*a* and the upper surface of the inner peripheral edge portion of the frame 10 elastically collide with each other via the second type buffer member 70. Also, when the balance of the vibrating system 12 is lost and the cylindrical portion 8*a* is largely moved on the side of the projecting portion 51*c*, the bottom surface of the cylindrical portion 8*a* and the upper surface of the projecting portion 51*c* elastically collide with each other via the second type buffer member 70. Thereby, the occurrence of the large abnormal sound can be effectively decreased, and the damage of the connecting member 8 can be prevented.

FOURTH EMBODIMENT

Next, the description will be given of a structure according to a fourth embodiment with reference to FIG. 6 and FIGS. 8A and 8B. In the fourth embodiment, similarly to the second and third embodiments, the connecting member 8 is designed to collide with the frame 10 via the second type buffer member 70 in the area E2. Thereby, in the areas E1 and E3, structurally, the collision of each component of the speaker device 100 can be avoided, and the occurrence of the large abnormal sound in the area E2 can be decreased.

Concretely, in the fourth embodiment, a structure obtained by combining the second embodiment and the third embodiment is employed. Namely, in the fourth embodiment, as shown in FIG. 6 and FIG. 8A, the second type buffer member 70 is attached on the bottom surface of the cylindrical portion 8*a* of the connecting member 8 in its circumferential direction. Instead, as shown in FIG. 8B, the plural small second type buffer members 70 may be discontinuously attached on the bottom surface of the cylindrical portion 8*a* in its circumferential direction respectively. In addition, the second type buffer member 70 is also attached on the upper surface of the inner peripheral edge portion of the frame 10, opposite to the bottom surface of the cylindrical portion 8*a* in its circumferential direction. Instead, the plural small second type buffer members 70 may be discontinuously attached on the upper surface of the inner peripheral edge portion of the frame 10, opposite to the bottom surface of the cylindrical portion 8*a*, in its circumferential direction. Further, as the necessity arises, the second type buffer member 70 may be attached on the upper surface of the projecting portion 51*c* of the pot type yoke 5.

When the excessive driving signal larger than the withstand input is inputted to the voice coil 4 and the voice coil bobbin 3 and the like largely move in the direction of the arrow 62, the cylindrical portion 8*a* and the upper surface of the inner peripheral edge portion of the frame 10 elastically collide with each other via the second type buffer member 70 in the area E2. Even when the balance of the vibrating system 12 is lost and the cylindrical portion 8*a* is largely moved on the side of the projecting portion 51, the bottom surface of the cylindrical portion 8*a* and the upper surface of the projecting portion 51*c* elastically collide with each other via the second type buffer member 70. Thereby, the occurrence of the large abnormal sound can be effectively suppressed, and the damage of the connecting member 8 can be prevented.

What is claimed is:

1. A speaker device comprising:

a voice coil bobbin;

a connecting member which is mounted to the voice coil bobbin; and a pot type yoke, wherein a buffer member is placed on a position at which the connecting member and the pot type yoke collide with each other, when the voice coil bobbin moves on a side of the pot type yoke at a time of driving.

2. The speaker device according to claim 1, wherein the pot type yoke has a cylindrical portion opposite to an outer peripheral wall of the voice coil bobbin, and wherein the buffer member is placed on a surface, opposite to an upper surface of the cylindrical portion, of the connecting member.

3. The speaker device according to claim 2, wherein the buffer member is placed on the connecting member in its entire circumference.

4. The speaker device according to claim 2, wherein the buffer member is discontinuously placed on the connecting member in its circumferential direction.

5. A speaker device comprising:

a voice coil bobbin;

a connecting member which is mounted to the voice coil bobbin;

a pot type yoke; and a frame, wherein the connecting member has a cylindrical portion opposite to an outer peripheral wall of the pot type yoke;

wherein the pot type yoke has a flange part opposite to a bottom surface of the cylindrical portion;

wherein the frame is mounted on an upper surface of the flange part; and wherein a buffer member is attached to a position at which the connecting member collides with the frame or the pot type yoke, when the voice coil bobbin moves on a side of the pot type yoke at a time of driving.

6. The speaker device according to claim 5, wherein the buffer member is attached to the bottom surface of the cylindrical portion.

7. The speaker device according to claim 5, wherein the buffer member is placed on the connecting member in its entire circumference.

8. The speaker device according to claim 6, wherein the buffer member is discontinuously placed on the connecting member in its circumferential direction.

9. The speaker device according to claim 6, wherein the buffer member is attached to the frame or the pot type yoke.

* * * * *